343-754 SR
9/1/81 XR 4,287,520

United States Patent [19]
Van Vliet et al.
[11] 4,287,520
[45] Sep. 1, 1981

[54] SLOT CHEVRON ELEMENT FOR PERIODIC ANTENNAS AND RADOMES

[75] Inventors: Robert M. Van Vliet, Greene County, Ohio; William R. Bushelle, St. Charles, Mo.

[73] Assignee: The United States of America as represented by the Secretary of the Air Force, Washington, D.C.

[21] Appl. No.: 92,817

[22] Filed: Nov. 9, 1979

[51] Int. Cl.[3] ..... H01Q 15/02
[52] U.S. Cl. ..... 343/909; 343/754
[58] Field of Search ..... 343/754, 767, 770, 771, 343/909, 872, 18 A, 18 B

[56] References Cited

U.S. PATENT DOCUMENTS 3,769,623 10/1973 Woo et al. ..... 343/909

OTHER PUBLICATIONS

Brocklehurst et al. "Exploratory Development of Resonant Metal Radomes", McDonnell Douglas Astronautics Co., St. Louis, Mo., Jul. 1978, AFML-TR-78-106.

"Efficient Dichroic Plate for Microwaves", NASA Tech Brief, Spring 1979, p. 4.

Pelton et al. "A Streamlined Metallic Radome", IEEE Trans. on Antenna and Propagation, Nov. 1974, pp. 799-803.

*Primary Examiner*—David K. Moore
*Attorney, Agent, or Firm*—Donald J. Singer; Thomas L. Kundert

[57] ABSTRACT

A periodic array for use as an electromagnetic energy resonant array or reflector having a high density pattern formed from individual chevron shaped elements. Various interlocked and interlaced patterns of elements provide the array designer with more flexibility in controlling bandwidth and stabilizing the functional relationship between frequency and the angle incidence with the electromagnetic energy. Furthermore, structural patterns of chevron shaped elements readily incorporate structural paths for lightning conduction and mechanical support without severely altering the electrical performance.

4 Claims, 9 Drawing Figures

PRIOR ART

SLOT CHEVRON ELEMENT FOR PERIODIC ANTENNAS AND RADOMES

RIGHTS OF THE GOVERNMENT

The invention described herein may be manufactured and used by or for the Government of the United States for all governmental purposes without the payment of any royalty.

BRIEF SUMMARY

The present invention is directed to structural patterns for resonant windows in the RF region of the electromagnetic spectrum, which patterns are comprised of multiple chevron shaped elements. A high density of the elements is attained by interlocking elements into rows and interlacing rows into patterns readily conforming to curvilinear contours. When necessary to route lightning strikes or provide load carrying structural support, the row organization of the chevron shaped elements lends itself to retaining substantially straight intermediate paths without severely affecting the electromagnetic characteristics of the window.

The ability to alter the orientation of the chevron legs in the elements while retaining the substantial character of the row configurations permits a designer to change the performance characteristics of the window without modifying its response to circularly polarized electromagnetic energy.

DETAILED DESCRIPTION

Recent developments in the art of RF signal transmission, reception and reflection have evolved a variety of resonant window or periodic array configurations. For the purpose of the embodiment in this disclosure the inquiry will be directed to a metallically coated radome of the type prevalent in aircraft and missile systems. In such cases the principal function of the radome is to pass electromagnetic signals with minimum attenuation and distortion. Other functions of the radome, nevertheless, cannot be ignored, and are specifically addressed by the present invention. These include the structural aspect and the electrical routing of lightning strikes and "P" static buildup. Though embodied in the transmissive form, the invention fully contemplates a reflective variant.

In the context of the embodiment the invention is directed toward overcoming three technological deficiencies of structures known in the art. Though fully recognized, they are not successfully controlled by a single structural configuration. First, the shape of the individual slot elements in the metallic layer of the radome, as well as the structural pattern formed therefrom, must be amenable to a very high slot density if bandwidth and frequency stability as a function of angle of incidence are to be adequately maintained. Inherent in this first requirement is a radome pattern which adequately passes circularly polarized RF energy. Secondly, the configuration must be conducive to incorporating in the pattern a number of substantially straight electrically conductive paths to route lightning strikes off the radome. However, attenuation and distortion levels must remain low. And lastly, structural patterns of slot elements must be capable of being conformed to contoured surfaces and incorporate structural support paths while retaining the RF performance.

A number of investigators have directed their inquiry to the use of slotted structural patterns in metallically coated radomes to form resonant arrays through which RF energy may be transmitted and received. U.S. Pat. Nos. 3,769,623 to Fletcher et al and 3,789,404 to Munk are exemplars. Variations in the shape and density of array slots in the pursuit of better electrical performance are addressed in U.S. Pat. No. 3,975,738 to Pelton et al., and in an article entitled "Efficient Dichroic Plate for Microwaves" on page 4 of the Spring 1979 issue of the NASA Tech Briefs. In the case of the latter, the filing of a patent application was noted. The invention is distinguishable from that taught in the art not only in the shape of each slot but also the structural pattern of multiple slots, though the pattern variations are substantially defined by the shape of the individual slot elements.

Figure 1:
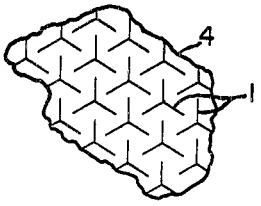
FIG. 1 PRIOR ART
FIGS. 1, 2 and 3 depict arrays of patterns generally within the art.
Figure 2:
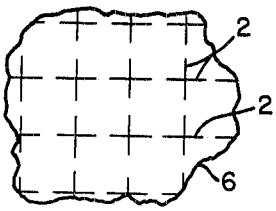
FIG. 2 PRIOR ART
Figure 3:
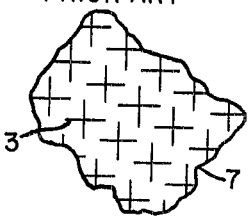

FIG. 1 represents the high density slot pattern taught by Munk, while the patterns in FIGS. 2 and 3 are described in the NASA Tech Brief. The latter, FIG. 3, is alleged to be a distinct improvement over the art shown in FIG. 2. Depicted slots 1, 2 and 3 represent openings in respective metallic sheets 4, 6 and 7.

Figure 4:
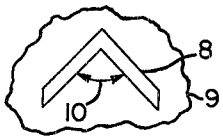
FIG. 4 shows a single chevron shaped element.

The individual slot element appearing in FIG. 4 represents the basic building block to which the invention is directed, having a shape conductive to the high density patterns and paths for structural support and lightning transmission. The shape of slot 8 in metallic sheet 9 is generally categorized as a chevron, having an angle of 90 degrees or less between adjacent legs. Since each leg functionally corresponds to a dipole, its size contributes to the overall bandwidth and transmission properties of the radome. The angle between the legs, 10, is instrumental in defining the polarization characteristics of the radome. In general, as the two legs approach a perpendicular orientation the polarization effects are less pronounced.

Figure 5:
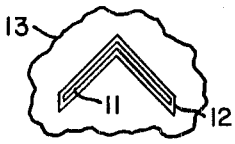
FIG. 5 shows a loaded configuration of the element in FIG. 4.

FIG. 5 shows the chevron shaped element in a loaded configuration. The increased capacitance created by metallic dipole pair 11 in dielectric filled slot 12 of metallic sheet 13 provides frequency stability and broader bandwidth. For purposes of this disclosure an alternate loading configuration is preferred, by which fine metallic powder such as aluminum is dispersed in a dielectric layer covering either side of metallic sheet 13 over the chevron shaped slots. Though accomplishing the same objective as the loaded configuration appearing in FIG. 5 this technique avoids the high rain erosion susceptibility of metallic dipoles 11. Therefore, the ensuing description will omit further reference to the loaded slot configuration.

Figure 6:
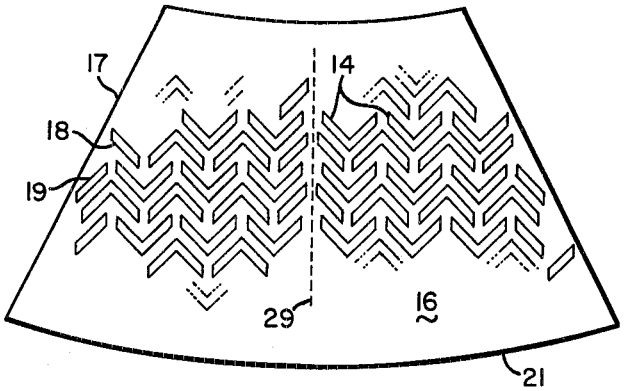
FIG. 6 schematically presents a segment of curvilinear radome having a pattern of interlaced chevron shaped elements.

Attention is now directed to FIG. 6, where one of the structural patterns comprising multiple chevron shaped slots 14 is depicted in curvilinear segment 16 of a metallic radome. Being schematic in nature, the figure is not shown to scale. The effects of a skewed edge, such as 17, are alleviated by splitting the chevron slot into individual dipole leg elements so that the envelope of the pattern conforms to the dimensional constraints of segment 16. Elements 18 and 19 are such legs. FIG. 6 shows the elements in parallel alignment, making it particularily difficult to conform the pattern to curved boundary 21 of radome segment 16. This obstacle is readily overcome by introducing a conforming curvature into the rows of elements. The pattern is retained by varying the angle, 10, between the chevron legs. Recognizing that analysis and testing must accompany such variations in the shape of the chevron, it remains clear, nevertheless, that the pattern may be blended into conformance with the boundary curvatures without altering its fundamental shape or pattern density.

Though appearing to be a detriment by way of complicating the patterns and performance criteria, the ability to alter the angle between the legs provides a skilled designer with flexibility heretofore unattained without concomitant sacrifices in other characteristics. In contrast to that disclosed herein, the prior art patterns appearing in FIGS. 1–3 are highly restrictive. Central to their structural constraint is the protruding character of the slot element legs of adjacent elements; a natural consequence of a shape having three or more legs. The chevron shape, on the other hand, is amenable to the high densities attained when the legs of adjacent elements are placed in parallel. It is, no doubt, well understood that adjacent slot elements cannot touch or overlap in all patterns.

Figure 7:
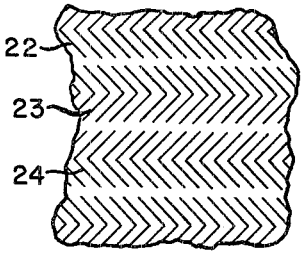
FIGS. 7, 8 and 9 schematically show some of the various patterns readily formed using chevron shaped elements.
Figure 8:
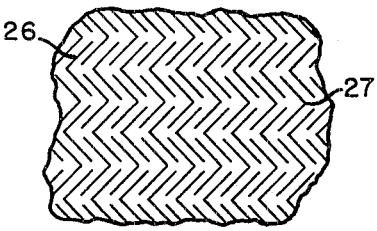
Figure 9:
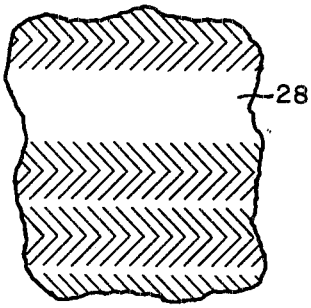

Examples of pattern variations appear in FIGS. 7, 8 and 9. The pattern shown in FIG. 7 contains parallel rows of interlocked chevrons in which the successive rows, for instance those designated by reference numbers 22–24, have the chevron apexes pointing in opposite directions. FIG. 8 shows a variation in which adjacent chevron rows, such as those designated 26 and 27, are interlaced in the manner first appearing in FIG. 6. In FIG. 9, the apexes are identical in direction but separated by structural path 28 having no slot elements. It should be noted that straight paths can be incorporated parallel to the chevron rows without breaking the continuity of the interlocked chevrons by selecting a path such as 28, between rows, or perpendicular to the rows, exemplified by path 29 in FIG. 6. In the latter case dipoles are used whenever the path bisects an individual chevron shaped element.

As embodied herein the radome is metallic with a pattern of dielectric, chevron shape slot elements. A radome structure fabricated with substantially straight paths, of the type described, provides inherent routes for precipitation static and lightning strikes, both being recognized problems for aircraft radomes. Furthermore, since radomes often carry pitot tubes or spikes, and are subjected to high aerodynamic loads, a metallic skeletal structure is distinctly useful for structural rigidity. Therefore, the metallic layer which was parasitic weight using prior art structural patterns now contributes to both the mechanical strength and lightning protection of the radome.

The embodiments as described herein were directed to patterns of slot elements in a metallic layer of the radome. It is, nevertheless, contemplated that the individual chevron shaped elements be metallic while the intermediate regions remain dielectric. As a further variant of the underlying concept, a pattern of chevron shaped elements is equally effective as a resonant reflector. Uses of resonant reflectors include radar antenna reflectors, scanned arrays, and dual frequency Cassegrain antenna systems.

I claim:

1. A metallic radome, comprising:

a. a curved surface of thin metallic material;

b. a plurality of chevron-shaped slots in said curved surface;

c. said chevron-shaped slots being formed of two linear slot elements connected end-to-end at an angle of substantially 90°;

d. said chevron-shaped slots being uniformly distributed on said curved surface in a closely spaced pattern with adjacent linear slot elements parallel to each other.

2. The device of claim 1, wherein said chevron-shaped slots are spaced on said curved surface so as to provide at least one uninterrupted substantially straight line conductive pathway along said curved surface.

3. The device of claim 1 further including a dielectric layer contiguous to said curved surface, said dielectric layer having means dispersed therein for capacitively loading said chevron-shaped slots.

4. The device of claim 3 wherein said means dispersed in the dielectric layer for capacitively loading said chevron-shaped slots is a fine metallic powder made of aluminum.

* * * * *